US006513510B2

(12) United States Patent
Hyung-Kee

(10) Patent No.: US 6,513,510 B2
(45) Date of Patent: Feb. 4, 2003

(54) METHOD FOR CONTROLLING FUEL SUPPLY OF A VEHICLE ON ACCELERATION AND A SYSTEM THEREOF

(75) Inventor: Kim Hyung-Kee, Suwon (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 09/925,347

(22) Filed: Aug. 8, 2001

(65) Prior Publication Data

US 2002/0059923 A1 May 23, 2002

(30) Foreign Application Priority Data

Nov. 20, 2000 (KR) ..... 00-68911

(51) Int. Cl.[7] ..... F02D 41/00
(52) U.S. Cl. ..... 123/696; 123/492
(58) Field of Search ..... 123/696, 492

(56) References Cited

U.S. PATENT DOCUMENTS 4,461,258 A * 7/1984 Becker et al. ..... 123/681
5,720,265 A * 2/1998 Maki et al. ..... 123/680
5,730,112 A * 3/1998 Jeong ..... 123/681
5,765,533 A * 6/1998 Nakajima ..... 123/492
5,899,192 A * 5/1999 Tsutsumi et al. ..... 123/492
6,092,508 A * 7/2000 Nakajima ..... 123/436
6,186,124 B1 * 2/2001 Stefanopoulou et al. .... 123/322

* cited by examiner

*Primary Examiner*—John Kwon
(74) *Attorney, Agent, or Firm*—Christie, Parker & Hale, LLP

(57) ABSTRACT

In order to reduce noxious exhaust gasses and to improve output power of an engine when it is accelerated, by determining whether an I-gain is out of a predetermined range if a vehicle driving condition is changed to acceleration, the I-gain and a P-gain are modified and fuel supply is controlled on the basis of the modified gains if the I-gain is out of the predetermined range.

Furthermore, by measuring a duration of inversion of the $O_2$ sensor, an additional amount of fuel supplied is calculated if the measured duration exceeds a predetermined duration.

10 Claims, 4 Drawing Sheets

METHOD FOR CONTROLLING FUEL SUPPLY OF A VEHICLE ON ACCELERATION AND A SYSTEM THEREOF

CROSS-REFERENCE TO RELATED APPLICATION

This application claims priority of Korea patent Application No. 2000-68911, filed on Nov. 20, 2000.

BACKGROUND OF THE INVENTION (a) Field of the Invention

The present invention relates to a method for controlling fuel supply of a vehicle on acceleration and a system thereof, and more particularly, to a method for controlling fuel supply such that an appropriate fuel supply is achieved quickly on acceleration, and noxious exhaust gasses are reduced and output power of an engine is increased at the same time.

(b) Description of the Related Art

Recent engines of vehicles are provided with an electronic control unit (written as ECU hereinafter), where the ECU, having data of operating conditions such as vehicle speed and engine speed being input, controls fuel supply for the engine by controlling injectors injecting fuel into the engine.

If an engine is accelerated by changing a throttle valve state from throttle valve off-state to throttle valve on-state, the throttle valve off/on-state being a state that the throttle valve is closed/opened, the ECU determines an appropriate amount of fuel to be supplied on acceleration and controls the injectors to inject the determined amount of fuel, the amount of fuel supplied being calculated on the basis of feedback gains.

The feedback gains include a proportional gain (written as P-gain hereinafter) that is proportional to an input signal from an $O_2$ sensor, and an integration gain (written as I-gain hereinafter) that is proportional to an integrated value of the input signal from the $O_2$ sensor. While under acceleration, these feedback gains are still considered to reduce noxious gasses included in exhaust gas.

More specifically, an amount of fuel supplied on acceleration is calculated by adding an acceleration correction value to a base amount of fuel multiplied by a short-term correction value and a long-term correction value, the acceleration correction value being determined through a predetermined process.

The base amount of fuel is an amount of fuel corresponding to a theoretical air/fuel ratio provided that a feedback signal is not considered. The short-term correction value is a correction value calculated on the basis of the real time I-gain and P-gain of the signal from the $O_2$ sensor, and the long-term correction value is a correction value calculated on the basis of the amount that a low pass filtered signal of the short-term correction value is out of a predetermined range.

The acceleration correction value is a correction value that is proportional to a change of load of an engine.

When the engine condition is in throttle valve off-state, in order to prevent the amount of fuel supplied from changing dramatically and thereby preventing stability of engine operation from deteriorating, the I-gain and P-gain are set to be less than when the engine condition is in throttle valve on-state.

Therefore, when accelerating from an initial throttle valve off-state, there may exist a duration when exhaust gas is lean, because the I-gain, being calculated on the basis of the integration value, is slow to increase.

FIG. 4 is a graph showing engine operation when accelerating from a throttle valve off-state at a vehicle speed of 20 km/h according to prior art.

As shown in FIG. 4, normally an $O_2$ sensor outputs a signal of a rich state when an engine is driven with a throttle valve off. This is because a base amount of fuel is set high to compensate for unstable combustion caused because an engine speed is high and engine load is very low.

In such a throttle valve off-state, an I-gain, used to calculate correction value, is set low.

Therefore, at the time the engine state is changed to a throttle valve on-state, the $O_2$ sensor detects lean exhaust gas because insufficient fuel is supplied even though an acceleration correction value is counted because the I-gain is initially set excessively low.

Moreover, exhaust gas is maintained lean until the I-gain is increased sufficiently because the I-gain is increased gradually.

Furthermore, the duration of the lean state of the exhaust gas, in which state a lot of nitrogen oxides ($NO_x$) are exhausted, is expanded because the I-gain is increased gradually, and in that duration the output power of the engine is reduced.

In addition, especially in an early state of engine operation, a hesitation phenomenon whereby the engine nearly stalls on acceleration, occurs because of a lack of wetted fuel on the walls of the air induction system causes a further lack of supplied fuel.

SUMMARY OF THE INVENTION

The present invention has been made in an effort to reduce noxious exhaust gasses and to improve output power of an engine at the same time by improving fuel supply control.

It is an objective of the present invention to provide a method and a system for controlling fuel supply of a vehicle on acceleration for quickly changing an amount of fuel supplied according to vehicle driving conditions by modifying values of feedback gains, and for determining an additional amount of fuel if a lean duration of exhaust gas exceeds a predetermined duration.

To achieve the above objective, the present invention provides a system and a method for controlling fuel supply of a vehicle on acceleration, wherein the system comprises a vehicle speed detector, an engine speed detector for detecting speed of engine revolution, a throttle valve open-angle detector, an $O_2$ sensor for detecting a lean/rich state of exhaust gas, an injector for injecting fuel into the engine, and a control unit that receives signals from the detectors and the $O_2$ sensor and controls an amount of fuel supplied by driving the injector on the basis of the received signals, wherein the control unit performs a method for controlling fuel supply according to the present invention.

The method according to the present invention, in which the control unit calculates a base amount of fuel, receives an output voltage of an $O_2$ sensor, and then calculates a P-gain on the basis of a voltage difference between the output voltage and a predetermined reference voltage, an I-gain on the basis of an integrated value of the voltage difference, and short-term and long-term correction values on the basis of the I-gain and the P-gain, comprises determining whether the vehicle is being accelerated, determining whether the I-gain is in a predetermined range if it is determined that the vehicle is being accelerated, modifying the I-gain and the P-gain if the I-gain is determined to be out of the predetermined range, calculating the long-term correction value on the basis of the modified I-gain and P-gain, calculating a total amount of fuel supplied on the basis of the long-term correction value, and driving an injector on the basis of the calculated total amount of fuel supplied.

Preferably, the step of modifying the I-gain and the P-gain modifies the I-gain by multiplying a difference between the I-gain and a reference I-gain by a first predetermined coefficient and then adding the reference I-gain, and modifies the P-gain by multiplying a difference between the P-gain and a reference P-gain by a second predetermined coefficient and then adding the reference P-gain.

The step of calculating a total amount of fuel supplied entails multiplying the base amount of fuel by the I-gain and the P-gain and then adding an acceleration correction value that is proportional to an amount of change in throttle valve open-angle.

It is also preferable that a method for controlling fuel supply according to the present invention further comprises calculating an additional amount of fuel if a detected duration of inversion exceeds a predetermined duration, wherein the step of calculating the total amount of fuel entails multiplying the base amount of fuel by the I-gain and the P-gain and then adding the additional amount of fuel and an acceleration correction value that is proportional to an amount of change in throttle valve open-angle.

The additional amount of fuel is calculated using the product of the inversion duration and a predetermined conversion factor, the sign of the conversion factor being defined according to the type of inversion among lean to rich inversion and rich to lean inversion.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

A preferred embodiment of the present invention will hereinafter be described in detail with reference to the accompanying drawings.

Figure 1:
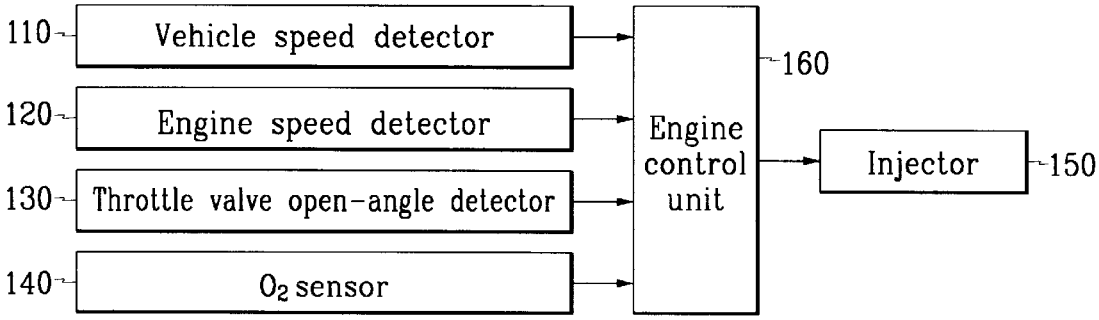
FIG. 1 is a block diagram of a system for controlling fuel supply of a vehicle on acceleration according to a preferred embodiment of the present invention.

FIG. 1 is a block diagram of a system for controlling fuel supply of a vehicle on acceleration according to a preferred embodiment of the present invention.

As shown in FIG. 1, a system for controlling fuel supply of a vehicle on acceleration according to the present invention includes a vehicle speed detector 110 for detecting vehicle speed, an engine speed detector 120 for detecting speed of engine revolution, a throttle valve open-angle detector 130 for detecting opening angle of a throttle valve, an $O_2$ sensor 140 for detecting a lean/rich state of exhaust gas, an injector 150 for injecting fuel into the engine, and a control unit 160 that receives signals from the detectors 110–130 and the $O_2$ sensor 140 and controls an amount of fuel supplied by driving the injector 150 on the basis of the received signals.

The control unit 160 is preferably a normal electronic control unit ECU.

Figure 2:
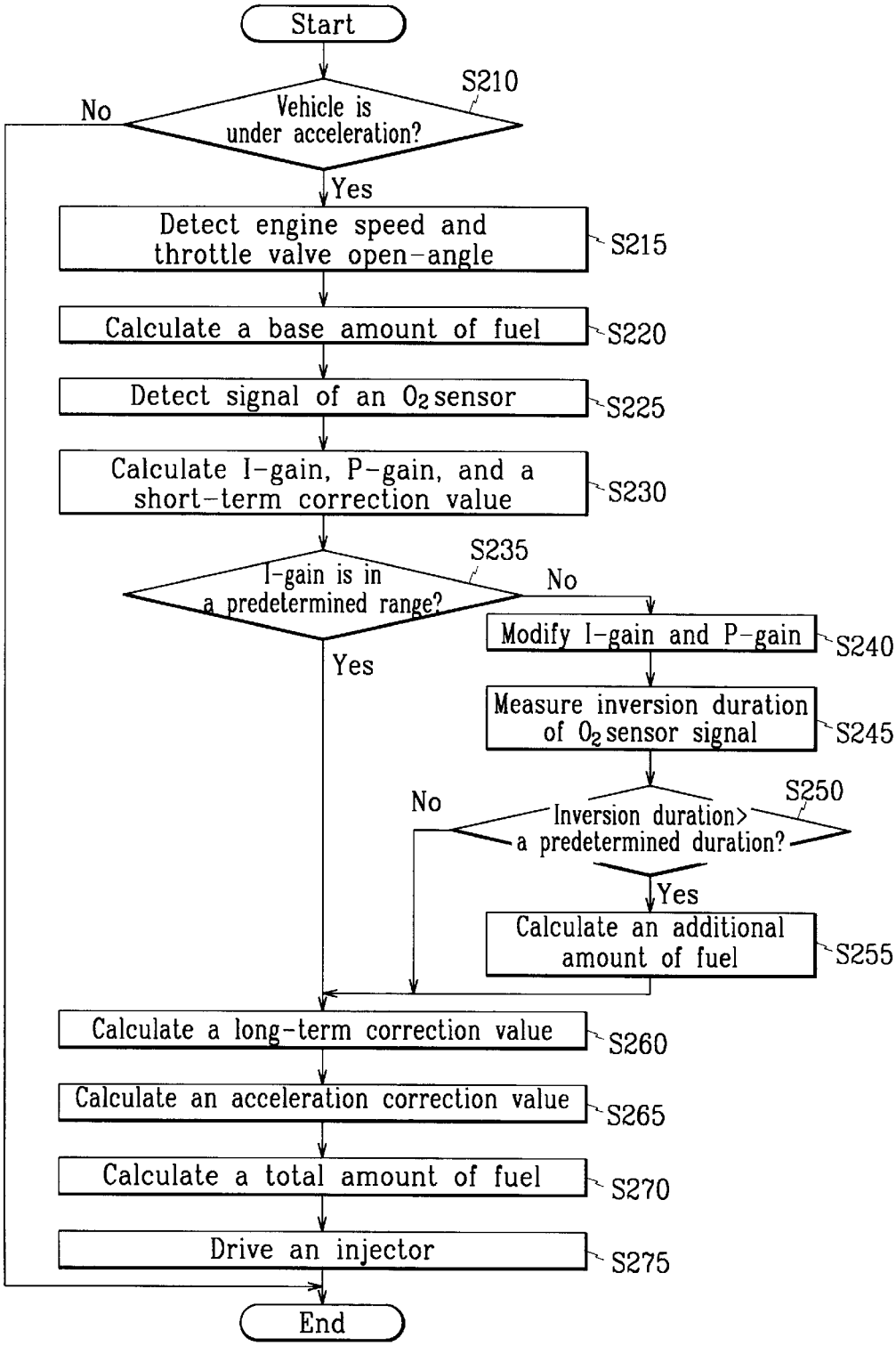
FIG. 2 is a flowchart showing a method for controlling fuel supply of a vehicle on acceleration according to a preferred embodiment of the present invention.

FIG. 2 is a flowchart showing a method for controlling fuel supply of a vehicle on acceleration according to a preferred embodiment of the present invention.

The control unit 160, as shown in FIG. 2, determines whether a vehicle is being accelerated at step S210.

The state of vehicle acceleration may be determined on the basis of increase of vehicle speed, but is preferably determined on a change of throttle valve from an off-state to an on-state on the basis of the input signal from the throttle valve open-angle detector 130.

A method for controlling fuel supply of a vehicle on acceleration according to the present invention comes to an end if the vehicle is determined to be not accelerating at step S210.

If the vehicle is determined to be accelerating at step S210, the control unit 160 detects engine speed and throttle valve open-angle at step S215, and calculates a base amount of fuel supplied on the basis of the detected data at step S220.

In addition, after detecting output voltage of the $O_2$ sensor 140 at step S225, the control unit 160 calculates feedback gains including an I-gain and a P-gain on the basis of the detected output voltage, and it further calculates a short-term correction value at step S230. The base amount of fuel and the short-term correction value are calculated in a normal way according to prior art.

Because the I-gain is an integrated value of a difference between a reference voltage and the output voltage of the $O_2$ sensor 140, the I-gain is gradually decreased if exhaust gas is lean and gradually increased if exhaust gas is rich.

Having calculated the short-term correction value, the control unit 160 determines whether the I-gain is in a predetermined range around a reference gain at step S235.

The reference gain is predetermined as a value such that the base amount of fuel is not corrected if the I-gain equals the reference gain.

The predetermined range may be set as any range such that the effect of correction on the basis of the I-gain becomes tangible, i.e., noxious exhaust gasses such as nitrogen oxide are exhausted if it is not corrected, when the I-gain is out of the range. For example, the range is set as 5% around the reference gain.

At step 240, the control unit 160 modifies the I-gain and the P-gain when the I-gain is out of the range.

The modification of the I-gain and the P-gain may be any kind of modification that increases the increasing/decreasing speed of the I-gain, with the I-gain increasing or decreasing according to the lean or rich state of the exhaust gas.

As an example, the I-gain is modified to a value obtained by multiplying the difference between the I-gain and a reference I-gain by a first predetermined coefficient and then adding the reference I-gain. That is, the I-gain is calculated by an equation "I-gain=(I-gain−a reference gain) * a first coefficient+a reference gain". The first coefficient in the above example is predetermined as a number greater than 1.

An example of the P-gain modification is the same as that for I-gain modification.

Having modified the I-gain and the P-gain, at step S245 the control unit 160 measures a duration of inversion, an inversion from being rich to being lean for example, of an output signal of the $O_2$ sensor 140 after the acceleration has started.

Subsequently the control unit determines whether the duration of inversion exceeds a predetermined duration at step S250.

The predetermined duration is any period of time that can be used as a criterion if correction for fuel is not sufficient, because the inverted state will be maintained for a greater period of time if correction for fuel supply is not sufficient.

Therefore, if the duration of inversion is determined to exceed the predetermined duration at step S250, the control unit calculates an additional amount of fuel at step S255.

The additional amount of fuel is calculated as a multiplication of the inversion duration and a predetermined conversion factor. The sign of the conversion factor is defined as positive if the inversion is from rich to lean, and as negative if the inversion is from lean to rich.

At step S260, the control unit 160 calculates a long-term correction value if the duration of inversion is determined not to exceed the predetermined duration at step S250, if the additional fuel is calculated at step S255, or if the I-gain is determined to be in the predetermined range at step S235. The long-term correction value is calculated in a normal way according to prior art.

Furthermore, the control unit 160 calculates an acceleration correction value in a normal way according to prior art at step S265, for example, proportionally to the amount of change in throttle valve open-angle.

Having calculated the long-term correction value, a total amount of fuel supplied is calculated at step S270 on the basis of the short-term and long-term correction value, the acceleration correction value and the additional amount of fuel.

The total amount of fuel is calculated by multiplying the base amount of fuel by the short-term correction value and the long-term correction value and then adding the additional amount of fuel and an acceleration correction value proportional to an amount of change in the throttle valve open-angle.

Figure 3:
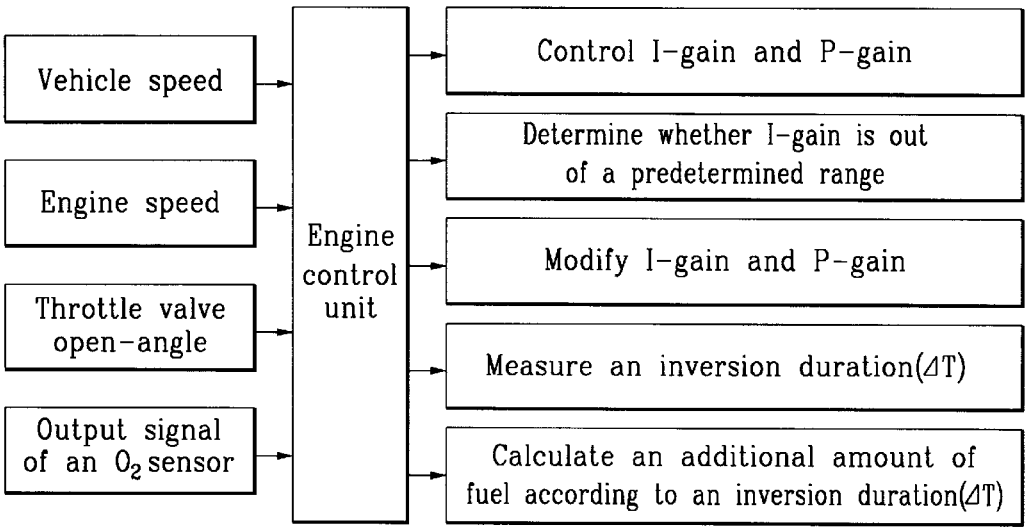
FIG. 3 is a conceptual drawing showing an operation of a control unit of a system for controlling fuel supply of a vehicle on acceleration according to a preferred embodiment of the present invention.
Figure 4:
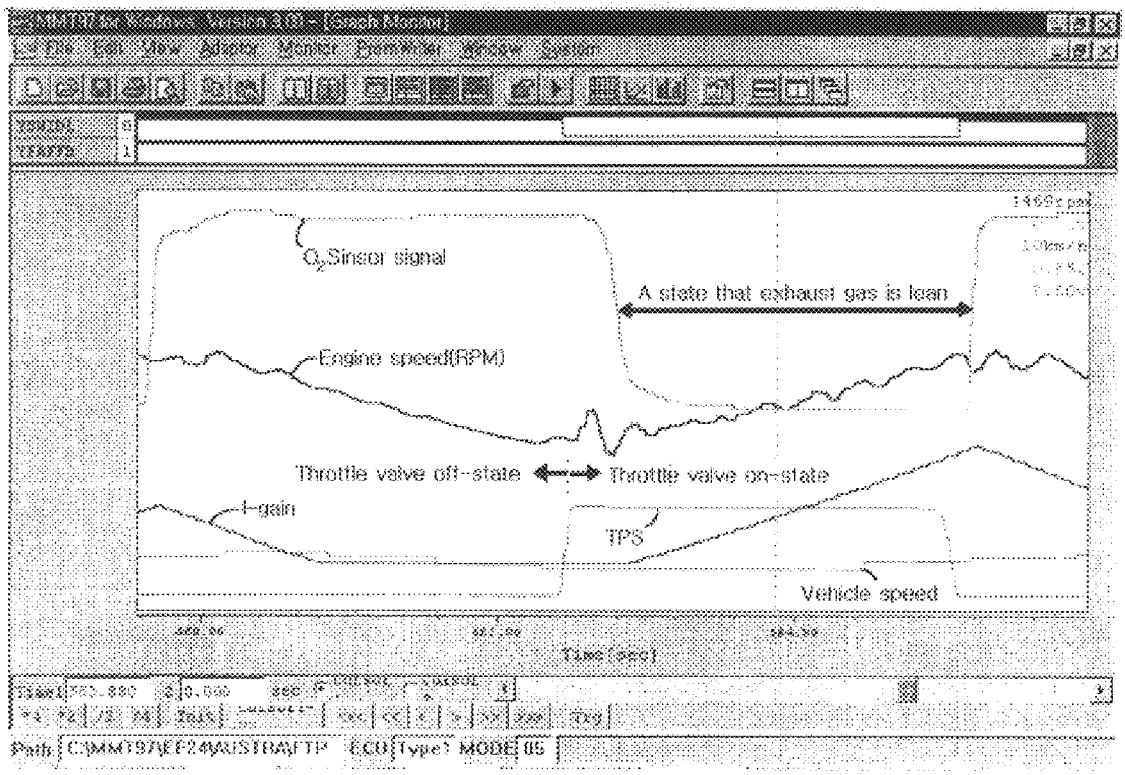
FIG. 4 is a graph showing engine operation when accelerating from a throttle valve off-state at a vehicle speed of 20 km/h according to prior art.

FIG. 3 conceptually shows operation of the control unit 160.

The control unit 160 respectively detects vehicle speed by the vehicle speed detector 110, engine speed by the engine speed detector 120, and throttle valve open-angle by the throttle valve open-angle detector 130, and 20 receives output voltage signals from the $O_2$ sensor 140.

On the basis of the detected parameters and the received signal, the control unit controls fuel supply, it determines whether I-gain is out of a predetermined range if a vehicle driving condition is changed to be under acceleration, and it modifies the I-gain and P-gain and controls fuel supply on the basis of the modified gains if the I-gain is out of the predetermined range.

Furthermore, after measuring the duration of inversion of the $O_2$ sensor 140, the control unit 160 calculates an additional amount of fuel supplied if the measured duration exceeds a predetermined duration.

According to a preferred embodiment of the invention, parameters for correcting fuel supply are quickly modified on the basis of the output voltage of the $O_2$ sensor when a vehicle is under acceleration. Consequently, this invention reduces the period of time that exhaust gas include noxious gasses because an appropriate air/fuel ratio is more rapidly recovered.

Furthermore, for the same reason, output power of an engine is increased on acceleration.

In addition, a hesitation phenomenon, possibly occurring when an engine has been recently started, is prevented because of the high recovering speed of the air/fuel ratio.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. A method for controlling fuel supply of a vehicle on acceleration, wherein a control unit, calculating a base amount of fuel, receives an output voltage of an $O_2$ sensor and then calculates a P-gain on the basis of a voltage difference between the output voltage and a predetermined reference voltage, an I-gain on the basis of an integrated value of the voltage difference, and short-term and long-term correction values on the basis of the I-gain and the P-gain, comprising:

determining whether the vehicle is being accelerated;

determining whether the I-gain is in a predetermined range if it is determined that the vehicle is being accelerated;

modifying the I-gain and the P-gain if the I-gain is determined to be out of the predetermined range;

calculating the long-term correction value on the basis of the modified I-gain and P-gain;

calculating a total amount of fuel supplied on the basis of the long-term correction value; and driving an injector on the basis of the calculated total amount of fuel supplied.

2. The method of claim 1, wherein the step of modifying the I-gain and the P-gain modifies the I-gain by multiplying a difference between the I-gain and a reference I-gain by a first predetermined coefficient and then adding the reference I-gain, and it modifies the P-gain by multiplying a difference between the P-gain and a reference P-gain by a second predetermined coefficient and then adding the reference P-gain.

3. The method of claim 1, wherein the step of calculating a total amount of fuel supplied entails multiplying the base amount of fuel by the short-term correction value and the long-term correction value and then adding an acceleration correction value that is proportional to an amount of change in throttle valve open-angle.

4. The method of claim 1, further comprising calculating an additional amount of fuel if a measured duration of inversion exceeds a predetermined duration, wherein the step of calculating the total amount of fuel entails multiplying the base amount of fuel by the short-term correction value and the long-term correction value and then adding the additional amount of fuel and an acceleration correction value that is proportional to an amount of change in throttle valve open-angle.

5. The method of claim 4, wherein the additional amount of fuel is calculated using the product of the inversion duration and a predetermined conversion factor, the sign of the conversion factor being defined according to the type of inversion among lean to rich inversion and rich to lean inversion.

6. A method for controlling fuel supply of a vehicle on acceleration, wherein a control unit, calculating a base amount of fuel, receives an output voltage of an $O_2$ sensor and then calculates a P-gain on the basis of a voltage difference between the output voltage and a predetermined reference voltage, an I-gain on the basis of an integrated value of the voltage difference, and short-term and long-term correction values on the basis of the I-gain and the P-gain, comprising:

determining whether the vehicle is being accelerated;

calculating an additional amount of fuel if a measured duration of inversion exceeds a predetermined duration;

calculating a total amount of fuel supplied on the basis of the long-term correction value; and driving an injector on the basis of the calculated total amount of fuel supplied.

7. The method of claim 6, wherein the step of calculating the total amount of fuel supplied entails multiplying the base amount of fuel by the short-term correction value and the long-term correction value and then adding an acceleration correction value that is proportional to an amount of change in a throttle valve open-angle.

8. A system for controlling fuel supply of a vehicle on acceleration, comprising:

a vehicle speed detector;

an engine speed detector for detecting speed of engine revolution;

a throttle valve open-angle detector;

an $O_2$ sensor for detecting a lean/rich state of exhaust gas;

an injector for injecting fuel into the engine; and a control unit that receives signals from the detectors and the $O_2$ sensor and controls an amount of fuel supplied by driving the injector on the basis of the received signals, wherein the control unit calculates a predetermined base amount of fuel, and, after determining whether an I-gain is in a predetermined range if the vehicle is under acceleration, modifies the I-gain and a P-gain if the I-gain is determined to be out of the predetermined range, and after calculating a long-term correction value on the basis of the modified I-gain and P-gain, calculates a total amount of fuel on the basis of the long-term correction value, and drives the injector on the basis of the calculated total amount of fuel supplied.

9. The system of claim 8, wherein:

modification of the I-gain is calculated by multiplying a difference between the I-gain and a reference I-gain by a first predetermined coefficient and then adding the reference I-gain;

modification of the P-gain is calculated by multiplying a difference between the P-gain and a reference P-gain by a second predetermined coefficient and then adding the reference P-gain; and the total amount of fuel supplied is calculated by multiplying a base amount of fuel by a short-term correction value and the long-term correction value and then adding an acceleration correction value that is proportional to an amount of change in the throttle valve open-angle.

10. The system of claim 8, wherein:

the control unit further calculates an additional amount of fuel if a detected duration of inversion exceeds a predetermined duration, wherein the additional amount of fuel is calculated using the product of the inversion duration and a predetermined conversion factor, the sign of the conversion factor being defined according to the type of inversion among lean to rich inversion and rich to lean inversion;

modification of the I-gain is calculated by multiplying a difference between the I-gain and a reference I-gain by a first predetermined coefficient and then adding the reference I-gain;

modification of the P-gain is calculated by multiplying a difference between the P-gain and a reference P-gain by a second predetermined coefficient and then adding the reference P-gain; and the total amount of fuel supplied is calculated by multiplying a base amount of fuel by a short-term correction value and the long-term correction value and then adding an acceleration correction value that is proportional to an amount of change in a throttle valve open-angle.

* * * * *